US006060670A

United States Patent [19]

Oikawa

[11] Patent Number: 6,060,670

[45] Date of Patent: May 9, 2000

[54] SLIDE SWITCH

[75] Inventor: Hiroshi Oikawa, Saitama, Japan

[73] Assignee: Toyodenso Kabushiki Kaisha, Tokyo, Japan

[21] Appl. No.: 09/138,286

[22] Filed: Aug. 21, 1998

[30] Foreign Application Priority Data

Sep. 2, 1997 [JP] Japan ..... 9-237165

[51] Int. Cl.[7] ..... H01H 15/00

[52] U.S. Cl. ..... 200/16 R; 200/252; 200/550

[58] Field of Search ..... 200/550, 563, 200/571, 572, 252, 16 R, 16 A, 16 C

[56] References Cited

U.S. PATENT DOCUMENTS 4,206,332 6/1980 Veenendaal ..... 200/252 X

*Primary Examiner*—Renee S. Luebke

*Attorney, Agent, or Firm*—Birch, Stewart, Kolasch & Birch, LLP

[57] ABSTRACT

On a terminal base 3, a terminal groove is provided to extend to a sliding direction of a movable contact 10, after a terminal 30 is inserted into the terminal groove 17, fixed on a rear side by caulking. Terminal base 3 has a coupler potion 20 on a rear side thereof and a coupler terminal 34 formed on an end of a terminal 30 projects into the coupler portion 20 through a through hole. On a surface side of the terminal base 3 on an opposite side of the coupler portion 20, a spacer 8 possessing a smooth sliding face is mounted substantially flush with the contact portion 31 so that lifting of the terminal 30 is prevented.

9 Claims, 10 Drawing Sheets

SLIDE SWITCH

BACKGROUND OF THE INVENTION

1. Field of the Invention

The present invention relates to a slide switch of type in which a movable contact slides on a stationary contact fixed on a terminal base.

2. Description of the Prior Art

A slide switch is known wherein a slider freely slidable in a designated direction and having a movable contact with a coupler integrated type terminal base is provided with a stationary contact on which the movable contact slides on a surface thereof. This switch is provided with a coupler on a rear face and a terminal formed with a end portion thereof formed on a coupler terminal projecting into a coupler portion and another portion being formed on said stationary contact. This switch is generally molded by projection molding and integrated with a terminal on the terminal base thereof.

By the way, in an above mentioned integrated molding of a terminal and a terminal base, a great deal of time is required when a terminal is set into a molding die while molding and when an end portion of a terminal is positioned. This causes unevenness on a surface of the terminal base, durability of the movable contact is reduced while the movable contact slides thereon.

Moreover, because there is a possibility that a position of the stationary contact is slipped off or deformed by the projection pressure, it is required to leave enough space between each stationary contact when a plurality of stationary contacts is inserted. Consequently, the size of the terminal base is increased and a degree of freedom in the design is reduced.

SUMMARY OF THE INVENTION

In order to solve the above problems, the present invention is characterized in a slide switch comprising, a slider freely slidable in a designated direction with a movable contact; a terminal base is formed in a sliding direction of the slider, a surface side thereof being adapted to be a sliding face of the slider and a coupler portion is provided on an end portion in a longitudinal direction on the rear face side thereof; and a terminal, a part of which is exposed on a surface side of the terminal base so as to be a stationary contact on which the movable contact slides, is provided with a coupler terminal projecting into the coupler portion on an end portion in a longitudinal direction thereof, wherein a terminal groove is formed to open on a surface of the terminal base having a shape into which the terminal can be fitted, the terminal is secured at a rear face side of the terminal base by caulking after the terminal has been inserted into the terminal groove and a spacer is attached on a surface side of the terminal base to cover a part of the terminal superposed on the coupler portion viewed from the surface side of the terminal base.

The spacer may have a smooth surface and be generally arranged to be flush with the stationary contact.

Since a terminal is inserted into a terminal groove formed on a beforehand molded terminal base from a surface side and is fixed by caulking on a rear side of the terminal base, it does not require a great deal of time for positioning as a conventional insert molding. Further, because it is not necessary to guard against slipping off of or deforming in a molding, it becomes possible to miniaturize the terminal base and design freedom is enhanced.

Further, since a spacer is attached on a surface of the terminal base to cover an upper part of a coupler portion viewed from a surface side of the terminal base, a coupler is prevented from rising to a surface side of the terminal base when connected with an external power supply side connector and a movable terminal can slide on the spacer. Therefore, since unevenness on a sliding face of the movable contact is reduced, durability of the movable contact can be improved.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENT

Figure 1:
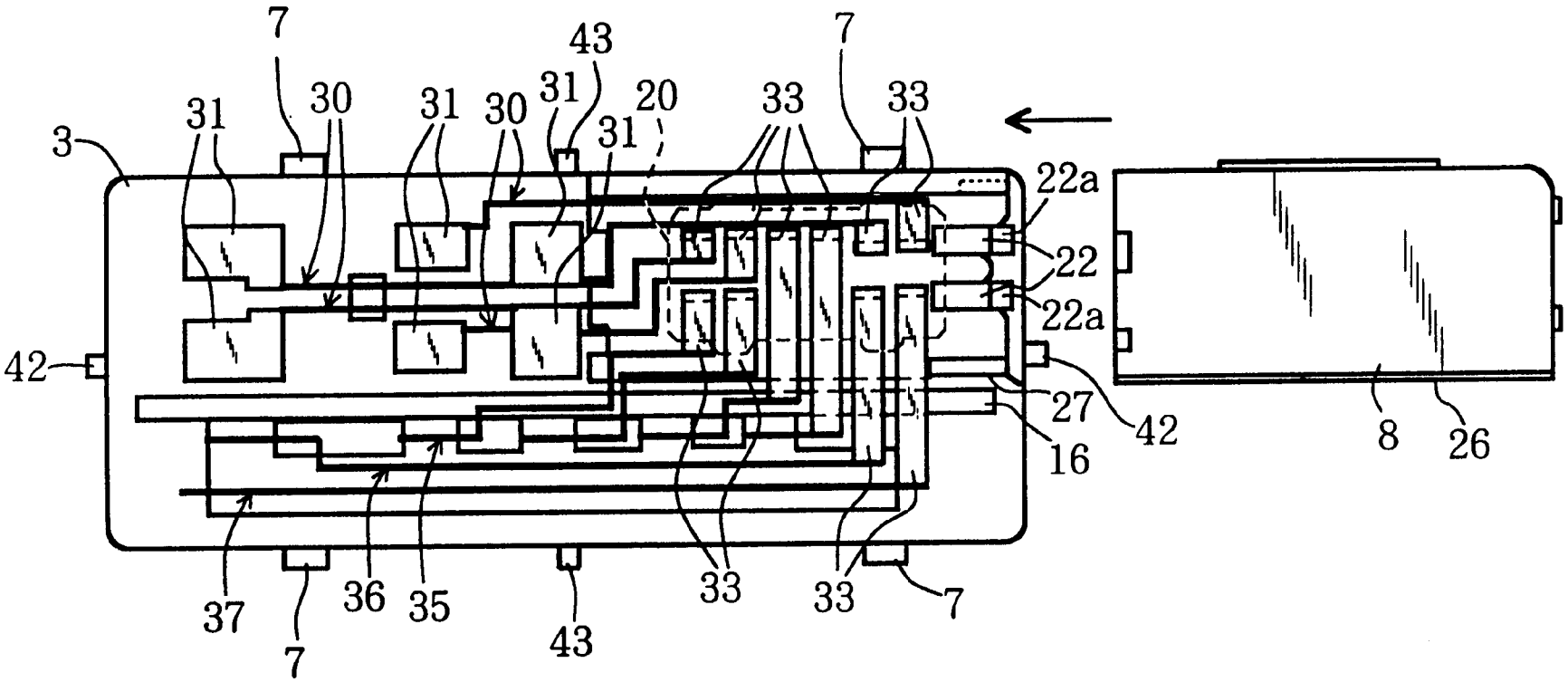
FIG. 1 is a view illustrating the mounting of a spacer on a terminal base.

According to FIG. 1 to FIG. 10*b*, an embodiment of the present invention constructed as a slide switch is illustrated.

This slide switch is of a generally oblong shape in a plan view and comprises a cover 1, slider 2 and terminal base 3. The cover 1 is made from resin, an elongated slide hole 4 is formed on a surface thereof and the slider 2 is supported and is freely slidable in a longitudinal direction in the slide hole 4 by a shift lever 5.

The cover 1 is generally box-shaped and is open on a rear side thereof, into which the terminal base 3 is fitted. Holes 6 are provided in the side walls with cover receiving claws 7 projecting from a side face of the terminal base 3 to integrate with the cover (See FIGS. 6 and 6*a*). Part of a surface of the terminal base 3 is covered by a spacer 8.

Figure 2:
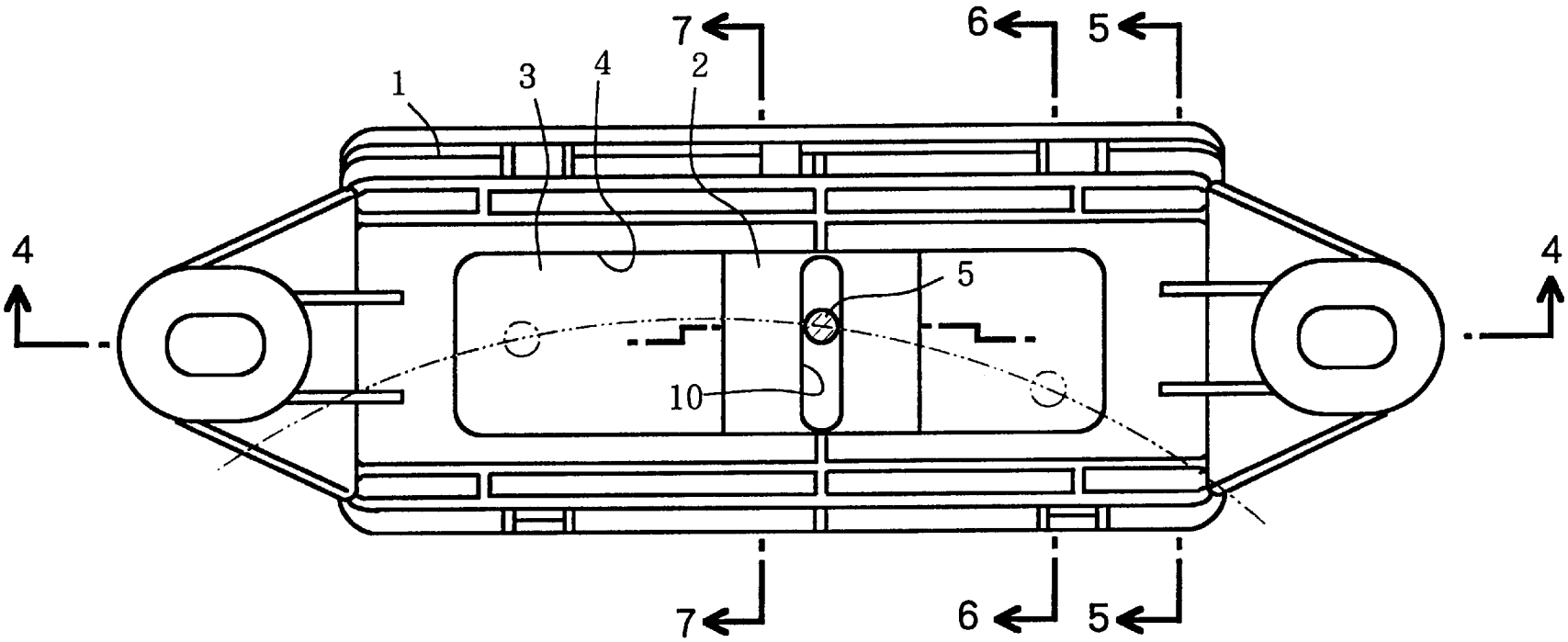
FIG. 2 is a plan view of the slide switch.
Figure 3:
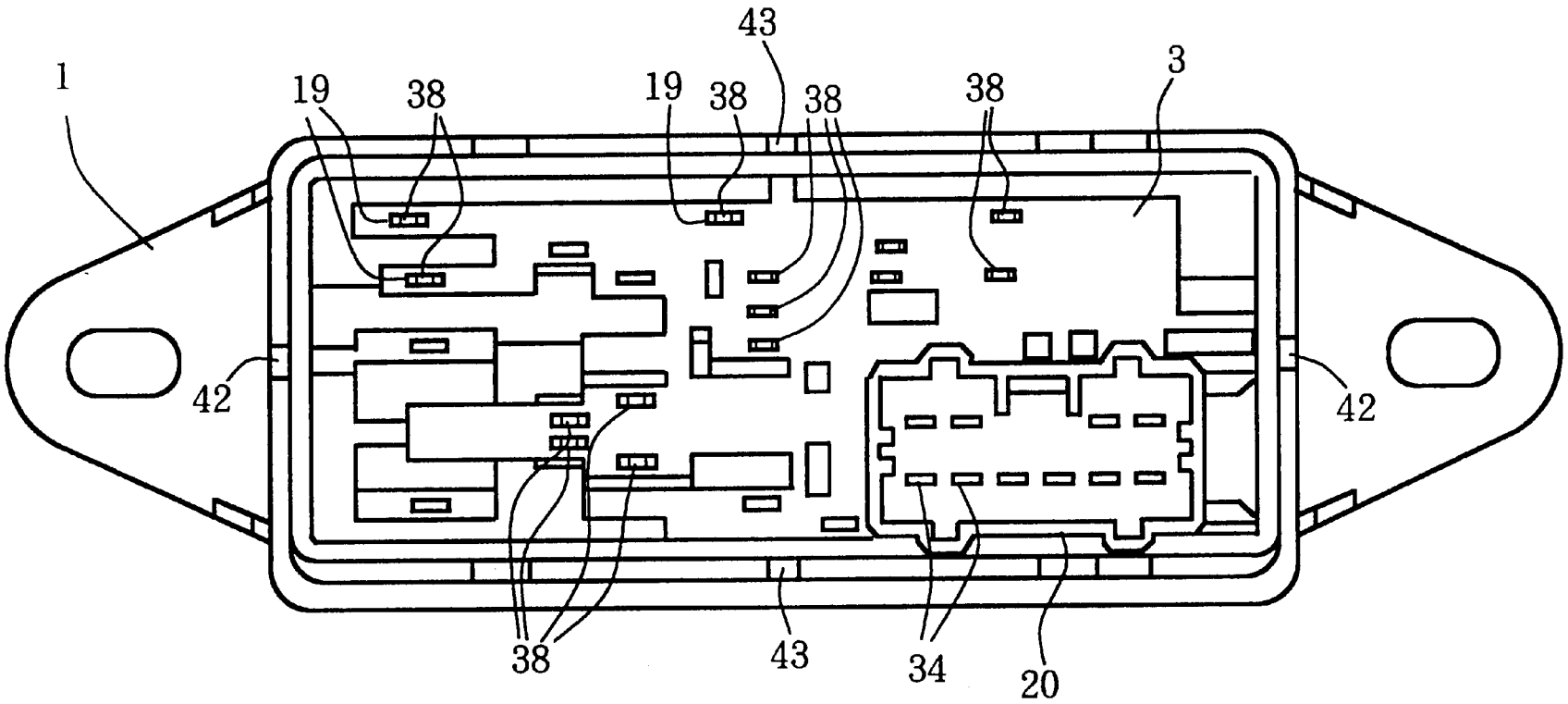
FIG. 3 is a rear view thereof.

In a center portion of the slider 2, a transversely elongated hole 10 is formed to allow movement of the lever 5 (See FIG. 2). As is apparent from FIG. 5, a first movable contact 11 is given a contact pressure by a first contact spring 12 engaging the rear side thereof. A second movable contact 13 is given a contact pressure by a second contact spring 14.

Figure 4:
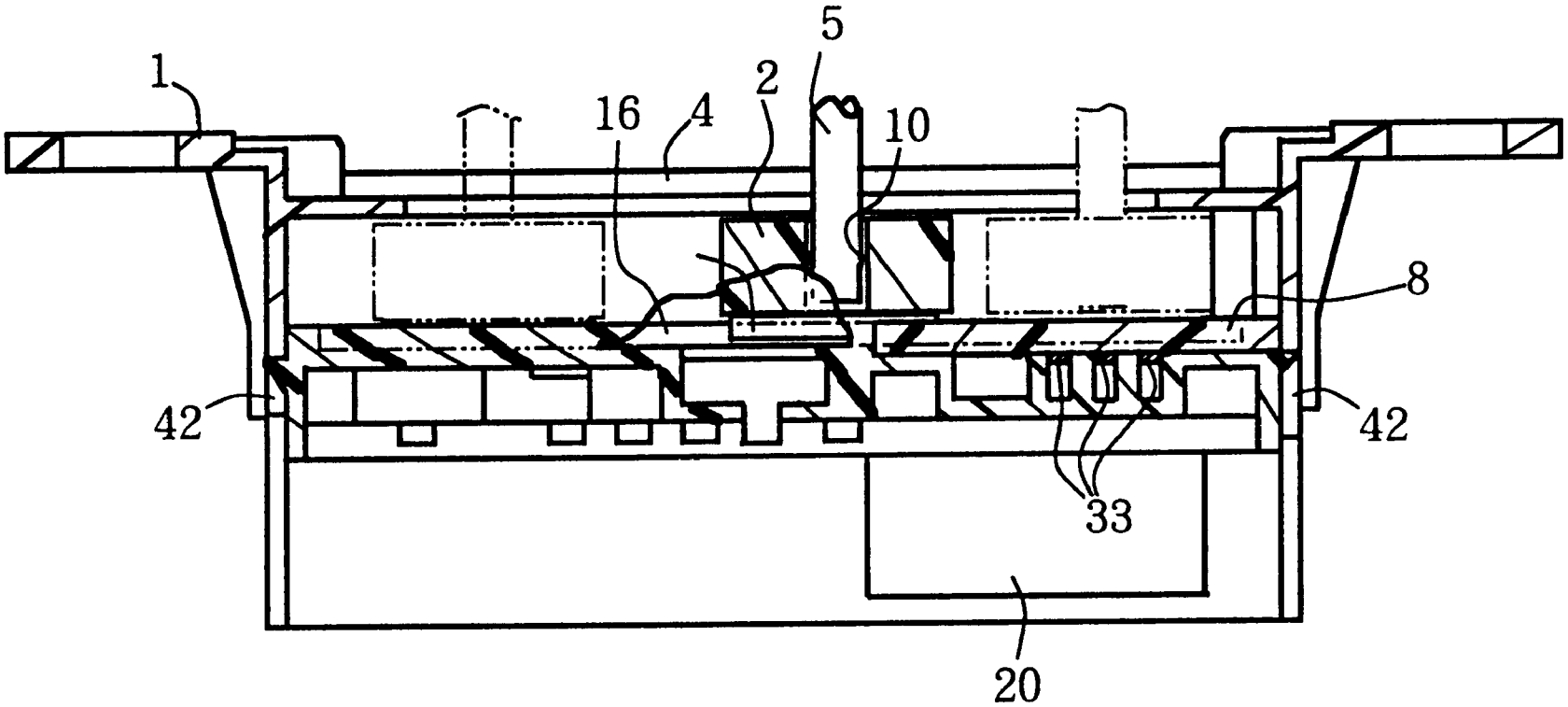
FIG. 4 is a sectional view taken along line 4—4 of FIG. 2.
Figure 8:
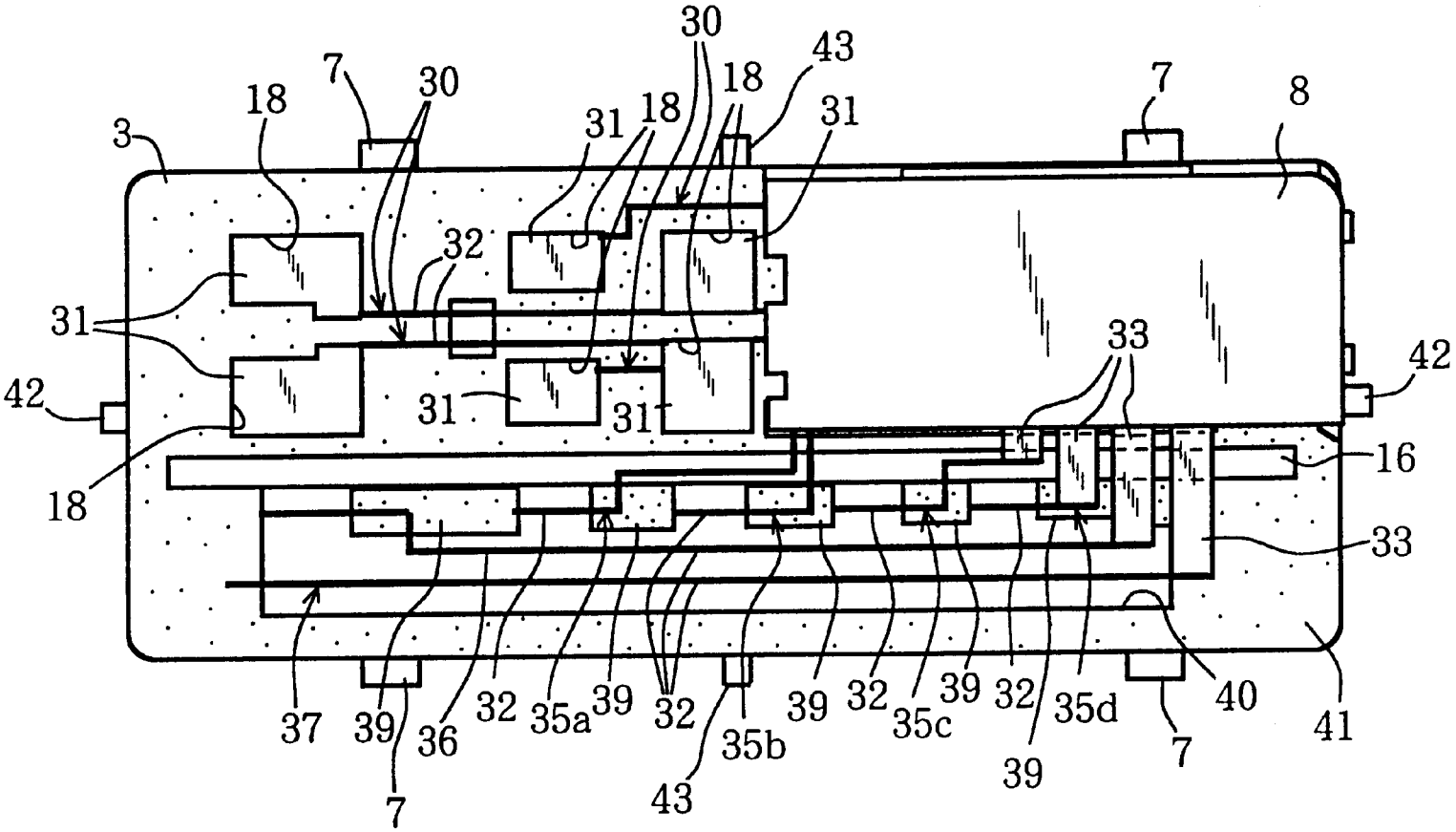
FIG. 8 is a plan view of the surface side of a terminal base.
Figures 9, 9A, 9B:
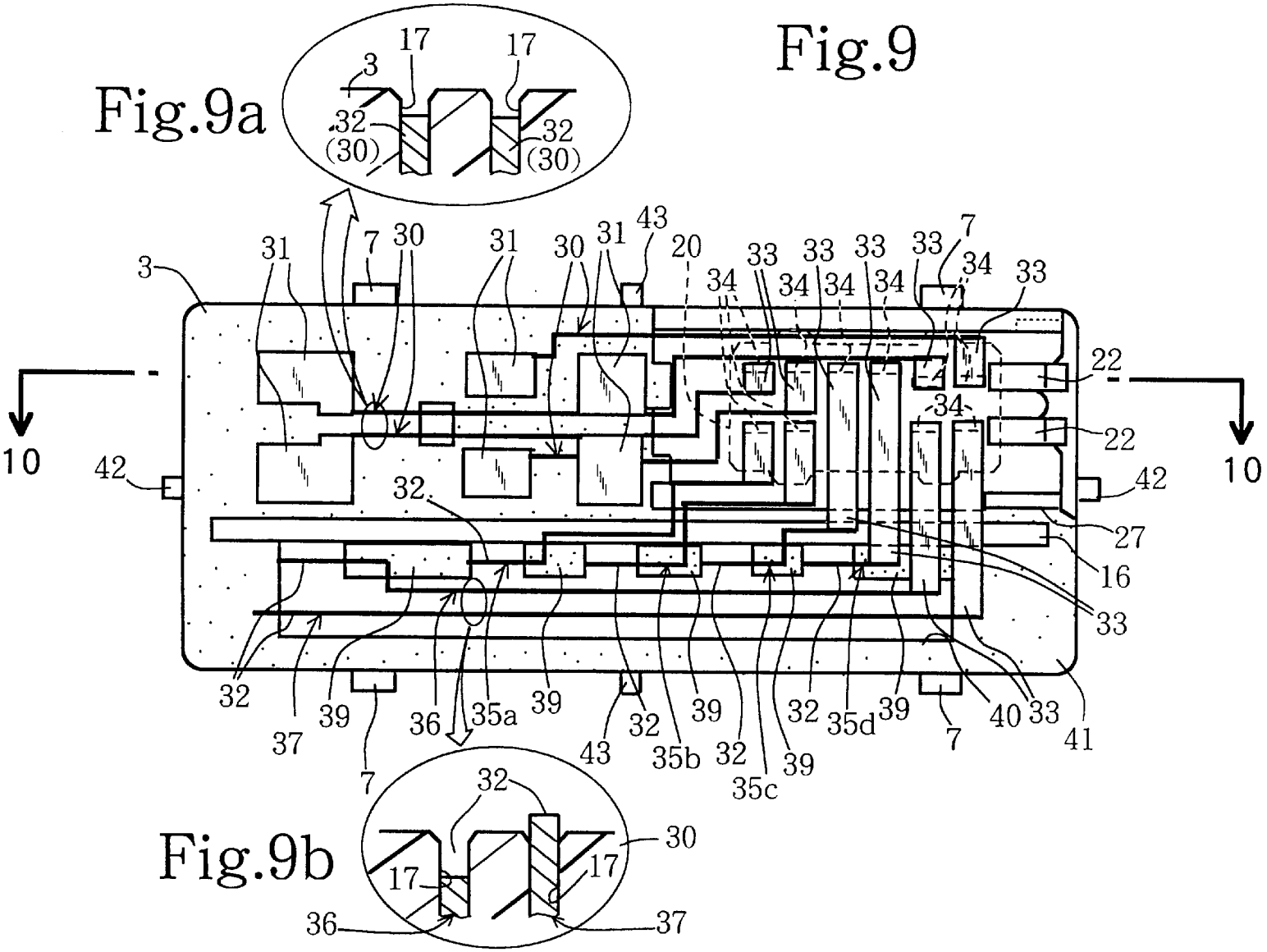
FIG. 9 is a plan view of the terminal base with a spacer removed.
FIG. 9*a* is an enlarged sectional view of a part of FIG. 9.
FIG. 9*b* is an enlarged section view of another pat of FIG. 9.
Figures 10, 10A, 10B:
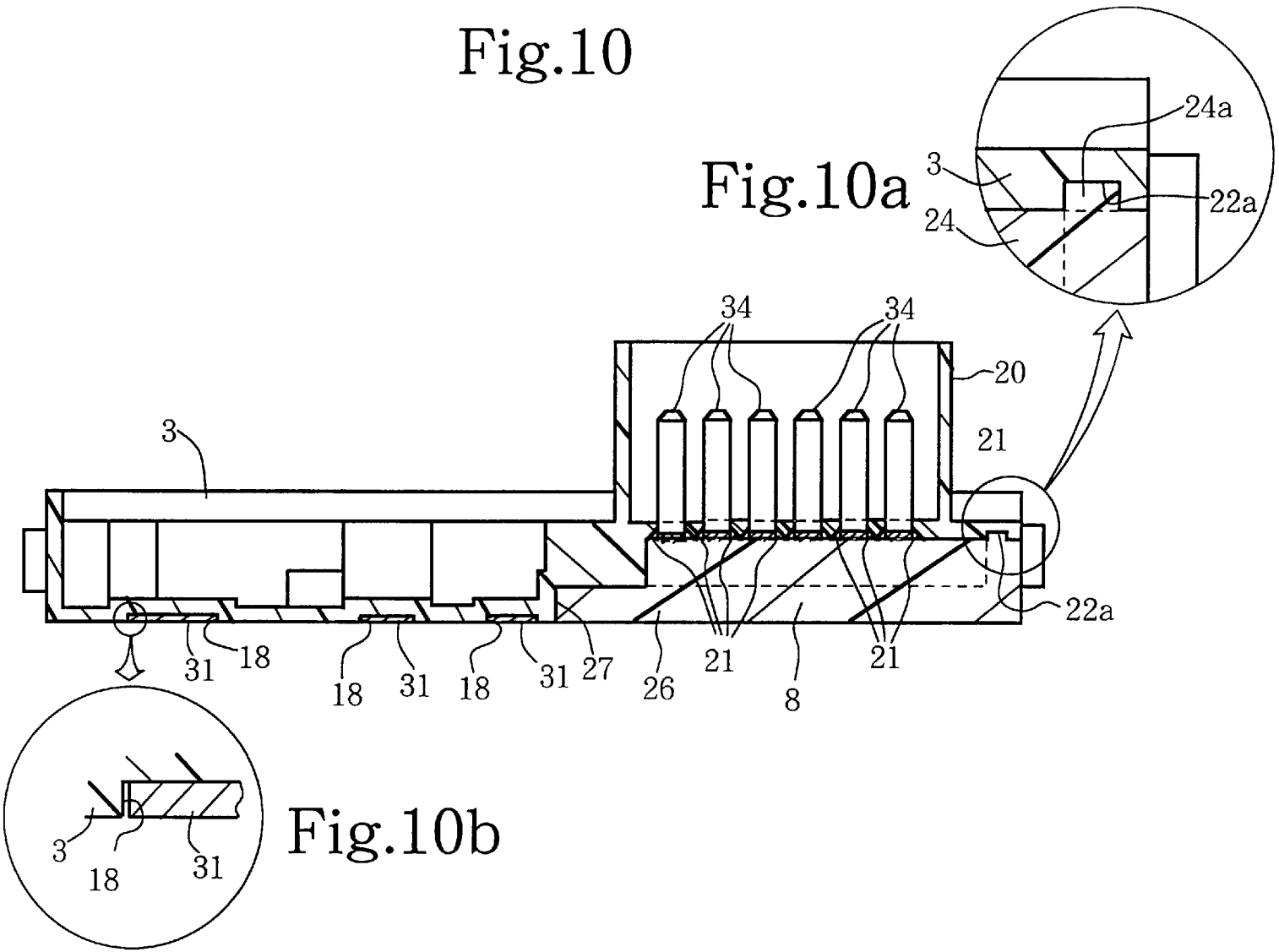
FIG. 10 is a sectional vies taken along line 10—10 of FIG. 9.
FIG. 10*a* is an enlarged view of a part of FIG. 10.
FIG. 10*b* is an enlarged view of another part of FIG. 10.

Between the first movable contact 11 and the second movable contact 13, a guide projection 15 is formed which is slidably received in a guide groove 16 formed on an center portion of the terminal base 3 in a longitudinal direction and adapted to guide the moving of the slider 2 along the guide groove 16 in a longitudinal direction (See FIG. 4, FIG. 8 and FIG. 9).

As is shown in FIGS. 9, 9*a* and 9*b*, the terminal base 3 is generally box-shaped resin-made elongated body corresponding to the cover 1. The top surface side thereof forms a sliding surface of the slider 2. A plurality of terminal grooves 17 are formed thereon extending to a sliding direction of the slider 2. The parts are shaped in generally the same shape as each part in a plan view to be able to be inserted with each terminal which is mentioned hereinafter and extends in a sliding direction of the slider 2.

Each terminal groove 17 is opened to a surface of the terminal base 3. A bottom portion of the terminal groove 17 communicates with a mounting hole 19 which extends lengthwise of the groove 17 and penetrates into a rear face of the terminal base 3. (See FIG. 3. Since there are many holes 19, only a portion thereof are shown as an example.)

On a surface of the terminal base 3, a recess 18 is formed to accommodate later described contact positions of the terminals (See FIGS. 10, 10*a* and 10*b*), and in a corner region of an end portion in the longitudinal direction on a rear face of the terminal base 3, a projecting coupler portion 20 is integrally formed.

A plurality of terminal grooves 21 are formed inside the coupler portion 20 penetrating the terminal base side 3. Moreover, on the surface of the terminal base 3 to which the spacer 8 is attached, a pair of positioning grooves 22 are formed (See FIGS. 9, 9*a* and 9*b*) to slightly enter inside from a shorter side on which the coupler portion 20 is formed, and engaging projections 23*a* and 23*b* are also formed in a pair along the longer side thereof to hold down an upper face of the spacer (See FIG. 5).

Figure 5:
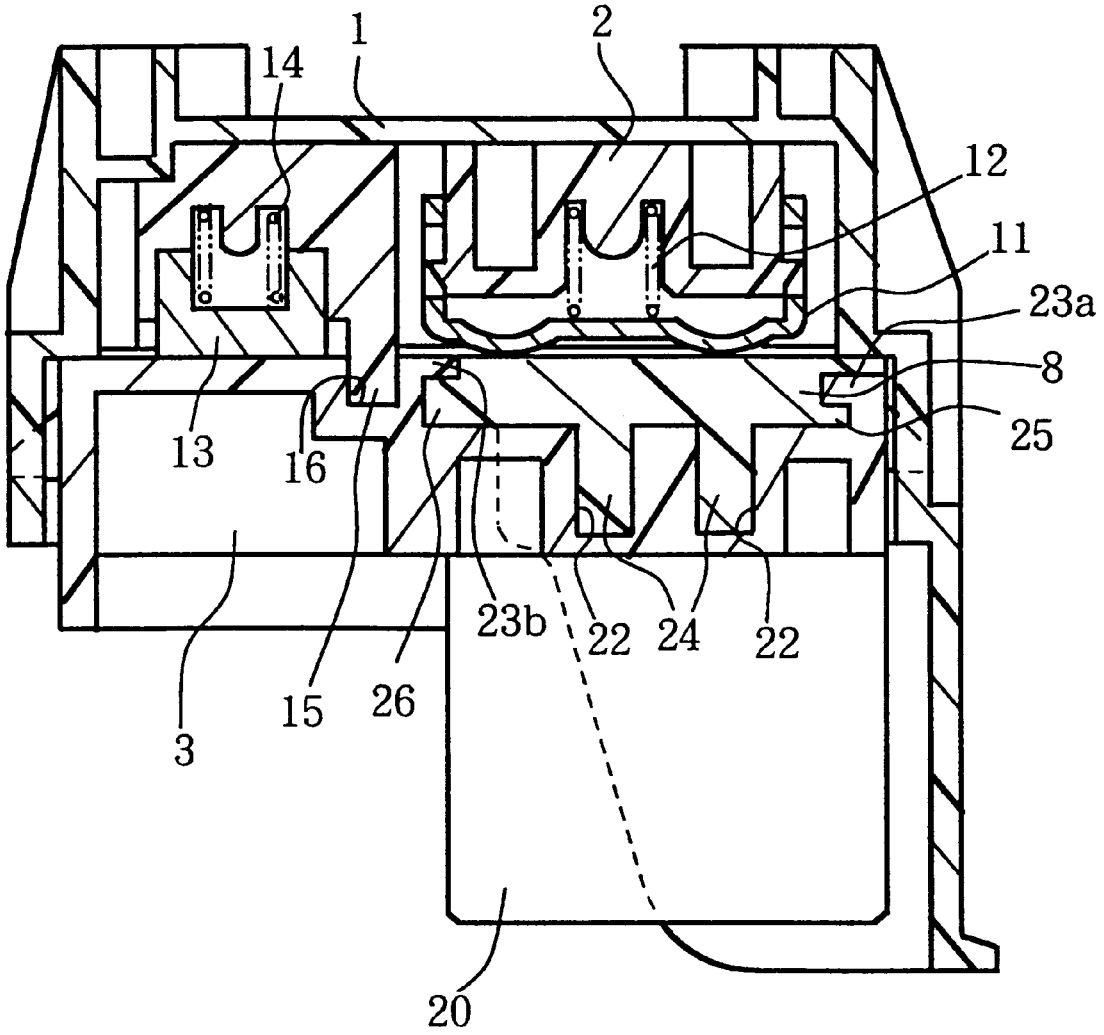
FIG. 5 is a sectional view taken along line 5—5 of FIG. 2.

As is apparent from FIG. 5, the spacer 8 is a resin-made plate-like member. On the rear face are two parallel positioning projections 24 which fit into the position grooves 22 and which are adapted to engage with a partially deepened engaging recess 22*a* by way of projection 24*a* on an end portion thereof. (See FIG. 10*a*.)

On one of the longer sides of the spacer 8, a U-shaped guide rail 25 engages a projection 23*a*. On the other longer side, a guide rail 26 is formed in a step-like shape which is inserted into a lower portion of the inner side engaging projection 23*b*.

A surface of the spacer 8 is a smoothed face. The spacer 8 is accommodated in the recess 27 in the terminal base 3, flush with a surface of the terminal base 3 (See FIGS. 9, 9*a* and 9*b*).

Figure 6:
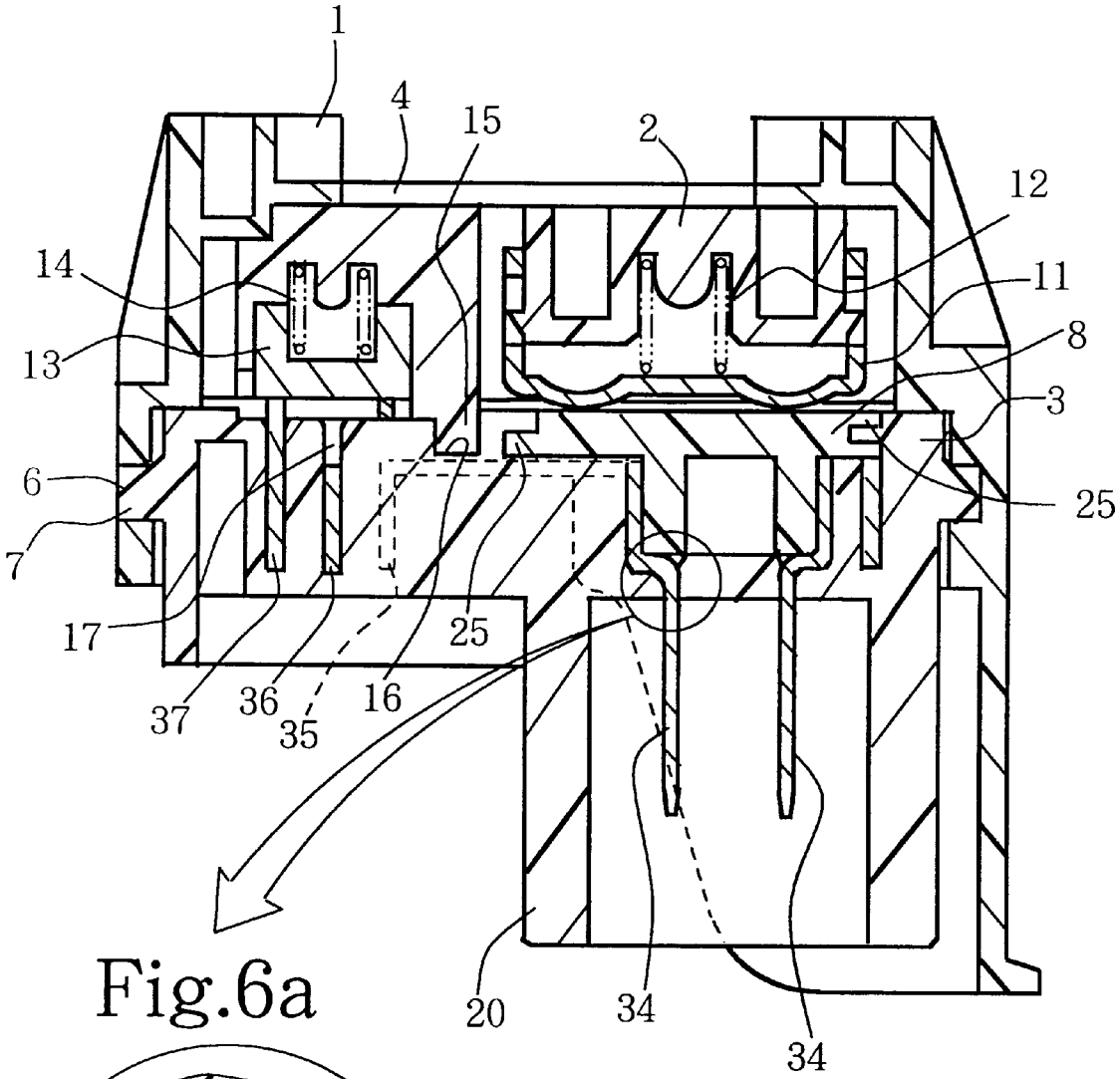
FIG. 6 is a sectional view taken along line 6—6 of FIG. 2.
Figure 6A:
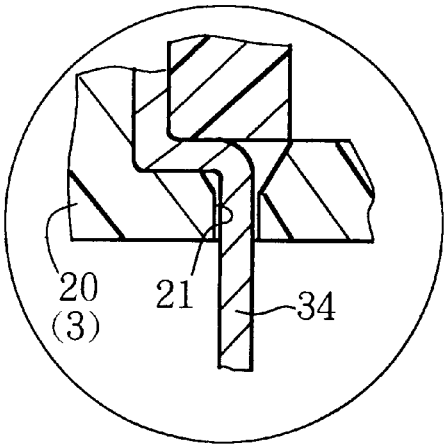
FIG. 6*a* is an enlarged view of a part of FIG. 6.
Figure 7:
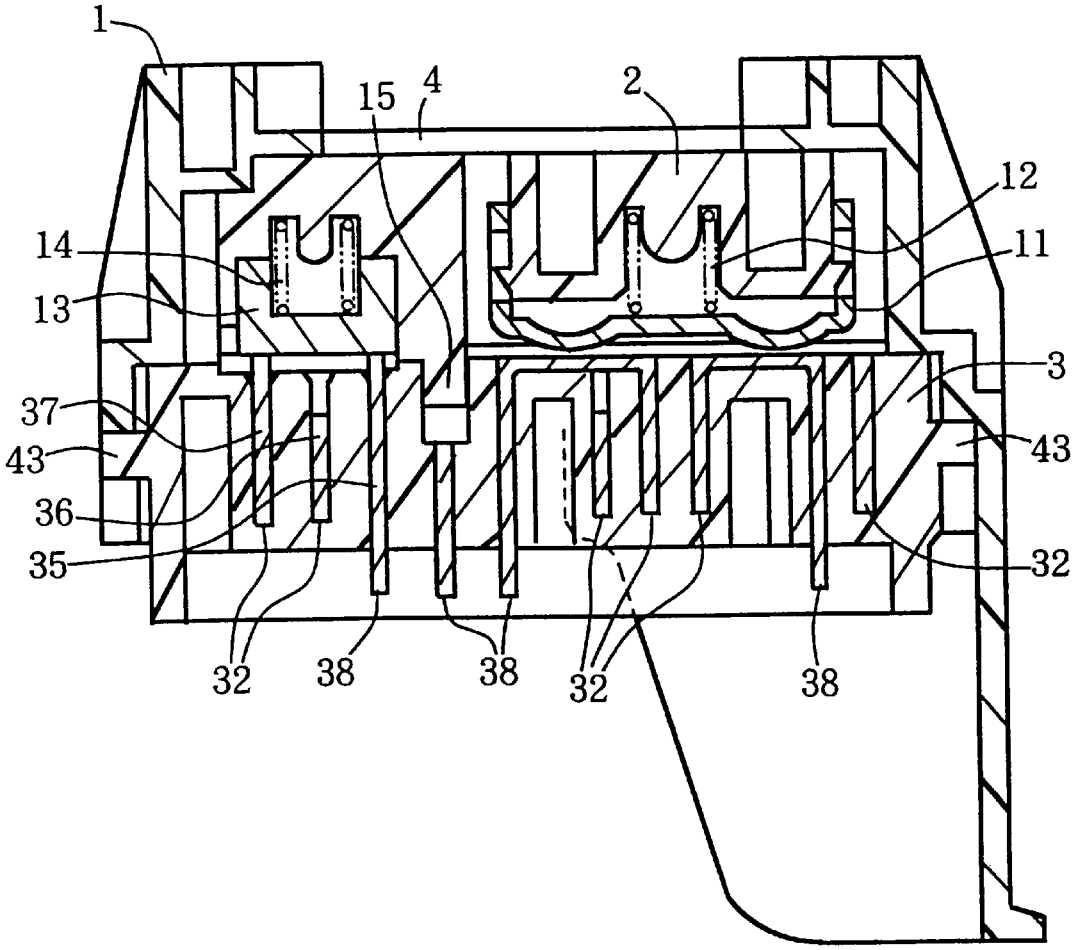
FIG. 7 is a sectional view taken along line 7—7 of FIG. 2.

Referring to FIG. 9, a terminal 30 includes a contact portion 31 being a plate-like stationary contact in plan view, a terminal groove inserting portion 32 bent at right angles from the contact portion 31 and inserted into the terminal groove 17, a bent portion 33 folded at about right angles on an upper position of the coupler portion 20 at an end portion of the terminal groove inserting potion 32 and a coupler terminal 34 having its tip bent downward in a right angle from the bent portion 33 (See FIGS. 6 and 6*a*).

However, terminals 35*a*, 35*b*, 35*c*, 35*d*, 36 and 37 which are attached below the guide groove 16 of the terminal base 3 are not provided with such contact portion 31 and a part of an end face of the terminal groove inserting portion 32 is arranged to make a sliding contact with the surface of the terminal base 3. Parts other than the projecting portions of the terminal groove inserting portions 32 are retracted deeply into the terminal groove 17 as shown in FIGS. 9*a* and 9*b*.

The terminal groove inserting portions 32 (See FIG. 8) of the terminals 30, 35*a*, 35*b*, 35*c*, 36 and 37 are respectfully inserted in corresponding grooves 17. The contact portion 31 are embedded in the recesses 18 and the tip ends of the coupler terminals 34 project into the coupler portion 20 while the coupler terminals 34 are inserted into the terminal grooves 21. (See FIGS. 6, 6*a*, 10 and 10*a*).

Fixing legs 38 (numeral is directed merely to a part thereof in FIG. 3) formed on a lower portion of the terminal groove inserting portion 32 project toward the rear side of the terminal base 3 through the mounting holes 19 which penetrate on a bottom portion of the terminal groove 17, and each of terminals 30, 35*a*, 35*b*, 36 and 37 is integrated with the terminal base 3 by fixing the projecting portions by caulking from the rear side of the terminal base 3.

In FIG. 8 and FIG. 9, a projection 39 makes the second movable contact 13 capable of smoothly moving without being caught and is flush with a common face 41 (the highest surface) of the terminal base 3 arranged from a periphery of a recess 40 accommodating the terminal mounted in the guide groove 16. In FIGS. 8 and 9, a part that is flush with the common face 41 in the surface of the terminal base 3 is shown with dots. Positioning projections 42 and 43 are utilized to mount the cover 1 on the terminal base 3.

Next, an operation of the present embodiment is described. The terminals 30, 35*a*, 35*b*, 35*c*, 35*d* and 37 are not molded integrally after being inserted into the terminal base 3, but after molding of the terminal base 3 they are inserted into the terminal groove 17 and fixed by caulking on the rear side of the terminal base 3.

Therefore, because a great deal of time is not required for positioning prior to insert molding, as is conventional, the terminals 30, 35*a*, 35*b*, 35*c*, 35*d*, 36 and 37 can be easily fixed and no consideration is needed to be given to position divergence or deformation while molding. Thus, miniaturization of the terminal base 3 becomes possible and the degree of freedom in the design is enhanced.

Moreover, because a part of the bending portion 33 is covered by the spacer 8, when the eternal power supply connector is connected to the coupler terminal 34, rising of the bending portion 33 side is prevented.

Further, since the surface of the spacer 8 is smooth and plate-like, unevenness on the sliding face of the first movable contact 11 is less so that the durability of the movable contact 11 is improved.

Also, because the first movable contact 11 slides on the spacer 8 flush with the other contact portions 31, unevenness on the whole sliding area is lessened and durability of the movable contact 11 can be more improved.

Furthermore, because the terminal 30, 35*a*, 35*b*, 35*c*, 35*d* and 36 are fixed by caulking, the surface side of the terminal base 3 is pressure-contacted to a caulking jig and the exposed part on the surface of the terminal base 3 and each of terminals 30, 35*a*, 35*b*, 35*c*, 35*d* and 36 are formed substantially to be mutually flush, so unevenness of the sliding face can be reduced.

What is claimed is:

1. A slide switch comprising:

a slider freely slidable in a predetermined direction and having a movable contact;

a terminal base extending in a sliding direction of the slider, a surface thereof being a sliding face for the slider and a coupler portion being provided at an end region of a rear face thereof; and a terminal, a part of which is exposed on a surface side of the terminal base to form a stationary contact on which the movable contact slides, and provided with a coupler terminal projecting into the coupler portion;

wherein a terminal groove is formed in a surface of the terminal base into which the terminal can be fitted, the terminal being secured at the rear of the terminal base by caulking after the terminal has been inserted into the terminal groove and a spacer is attached to the terminal base to cover a part of the terminal superposed on the coupler portion as viewed from the surface of the terminal base, said spacer maintaining said coupler terminal in said coupler portion while permitting said slider to move there across.

2. The slide switch according to claim 1, wherein the spacer has a smooth surface and is generally flush with the stationary contact.

3. The slide switch according to claim 1, wherein a recess is formed in the terminal base and said spacer fits within said recess to form a flush surface with said terminal base.

4. A slide switch comprising:

a slider freely slidable in a predetermined direction and having a movable contact;

a terminal base extending in a sliding direction of the slider, a surface thereof being a sliding face for the slider and a coupler portion being provided at an end region of a rear face thereof; and a terminal, a part of which is exposed on a surface side of the terminal base to form a stationary contact on which the movable contact slides, and provided with a coupler terminal projecting into the coupler portion, said terminal includes terminal groove inserting portions bent at an angle to said stationary contact and being disposed within respective terminal grooves;

wherein a terminal groove is formed in a surface of the terminal base into which the terminal can be fitted, the terminal being secured at the rear of the terminal base by caulking after the terminal has been inserted into the terminal groove and a spacer is attached to the terminal base to cover a part of the terminal superposed on the coupler portion as viewed from the surface of the terminal base.

5. The slide switch according to claim 4, wherein said terminal further includes a second bent portion folded at an angle on an upper portion of the coupler portion at an end portion of the terminal groove and a coupler terminal having a tip bent downwardly at an angle to the second bent portion.

6. The slide switch according to claim 5, wherein said spacer covers said second bent portion of said terminal to prevent rising of the second bent portion when a power supply is engaged with said coupler portion.

7. A slide switch comprising:

a slider freely slidable in a predetermined direction and having a movable contact;

a terminal base extending in a sliding direction of the slider, a surface thereof being a sliding face for the slider and a coupler portion being provided at an end region of a rear face thereof; and a terminal, a part of which is exposed on a surface side of the terminal base to form a stationary contact on which the movable contact slides, and provided with a coupler terminal projecting into the coupler portion;

wherein a terminal groove is formed in a surface of the terminal base into which the terminal can be fitted, the terminal being secured at the rear of the terminal base by caulking after the terminal has been inserted into the terminal groove and a spacer is attached to the terminal base to cover a part of the terminal superposed on the coupler portion as viewed from the surface of the terminal base, said spacer includes a U-shaped guide rail on at least one side thereof for securing said spacer to a guide rail mounted on said terminal base.

8. A slide switch comprising:

a slider freely slidable in a predetermined direction and having a movable contact;

a terminal base extending in a sliding direction of the slider, a surface thereof being a sliding face for the slider and a coupler portion being provided at an end region of a rear face thereof; and a terminal, a part of which is exposed on a surface side of the terminal base to form a stationary contact on which the movable contact slides, and provided with a coupler terminal projecting into the coupler portion;

wherein a terminal groove is formed in a surface of the terminal base into which the terminal can be fitted, the terminal being secured at the rear of the terminal base by caulking after the terminal has been inserted into the terminal groove and a spacer is attached to the terminal base to cover a part of the terminal superposed on the coupler portion as viewed from the surface of the terminal base, said spacer includes a guide rail on at least one side thereof for securing said spacer to a guide rail mounted on said terminal base.

9. A slide switch comprising:

a slider freely slidable in a predetermined direction and having a movable contact;

a terminal base extending in a sliding direction of the slider, a surface thereof being a sliding face for the slider and a coupler portion being provided at an end region of a rear face thereof;

a terminal, a part of which is exposed on a surface side of the terminal base to form a stationary contact on which the movable contact slides, and provided with a coupler terminal projecting into the coupler portion; and a first movable contact and a second movable contact, a guide projection is disposed with a guide groove extending lengthwise in a center region of said terminal base to guide the movement of the slider;

wherein a terminal groove is formed in a surface of the terminal base into which the terminal can be fitted, the terminal being secured at the rear of the terminal base by caulking after the terminal has been inserted into the terminal groove and a spacer is attached to the terminal base to cover a part of the terminal superposed on the coupler portion as viewed from the surface of the terminal base.

* * * * *